US006202274B1

(12) United States Patent
Vatne

(10) Patent No.: US 6,202,274 B1
(45) Date of Patent: Mar. 20, 2001

(54) ARRANGEMENT FOR FASTENING A PISTON-CYLINDER ARRANGEMENT AND METHOD FOR REPLACING SEALINGS THEREIN

(75) Inventor: Per Vatne, Rabbersvik (NO)

(73) Assignee: Maritime Hydraulics AS, Kristiansand (NO)

( * ) Notice: Subject to any disclaimer, the term of this patent is extended or adjusted under 35 U.S.C. 154(b) by 0 days.

(21) Appl. No.: 09/117,616

(22) PCT Filed: Jan. 31, 1997

(86) PCT No.: PCT/NO97/00025

§ 371 Date: Jul. 30, 1998

§ 102(e) Date: Jul. 30, 1998

(87) PCT Pub. No.: WO97/28347

PCT Pub. Date: Aug. 7, 1997

(30) Foreign Application Priority Data

Jan. 31, 1996 (NO) ..... 960412

(51) Int. Cl.[7] ..... B23P 6/00

(52) U.S. Cl. ..... 29/402.08; 254/386; 175/113; 175/202; 175/203

(58) Field of Search ..... 29/402.08; 254/386; 175/122, 113, 114, 118, 121, 162, 202, 203

(56) References Cited

U.S. PATENT DOCUMENTS 4,170,340 10/1979 Mouton, Jr. ..... 254/386
4,341,373 7/1982 Mouton, Jr. ..... 254/386
4,341,383 7/1982 Reichert ..... 463/4
5,069,426 12/1991 Gabrysch ..... 254/29 R
5,638,911 * 6/1997 Beechwood et al. ..... 175/162

FOREIGN PATENT DOCUMENTS 870 387 3/1953 (DE) .

* cited by examiner

*Primary Examiner*—S. Thomas Hughes
*Assistant Examiner*—John C. Hong
(74) *Attorney, Agent, or Firm*—Pillsbury Madison & Sutro LLP

(57) ABSTRACT

A mounting apparatus for a piston-cylinder arrangement (10,11) in a derrick (1) placed on a drill floor (2), which hydraulic piston-cylinder arrangement (10,11) is adapted to raise and lower a yoke (8) which travels on guide rails (7) in the derrick (1) itself, where the cylinder (20) is firmly held by a mounting apparatus (31) in relation to the drill floor (2). For the changing of gaskets (27) on the piston (21) and the cylinder (20), the cylinder is arranged so as to be lowerable in relation to the mounting thereof. The mounting apparatus (31) is designed to be releasable and comprises a flange (32) permanently mounted on the cylinder (20), a fixing device (37) in fixed position in relation to drill floor (2), a dividable locking ring (34), and a locking device (32) and the fixing device (37) and being firmly held in engagement with the aid of the locking device (38). A method of changing gaskets on a piston and cylinder is also described.

8 Claims, 6 Drawing Sheets

ARRANGEMENT FOR FASTENING A PISTON-CYLINDER ARRANGEMENT AND METHOD FOR REPLACING SEALINGS THEREIN

The present invention relates to an apparatus for mounting a piston-cylinder arrangement in a derrick, comprising two or more hydraulic piston-cylinder arrangements for raising and lowering a yoke which travels on guide rails in the derrick itself, and a method of changing gaskets in this type of piston-cylinder arrangement.

A derrick structure which was developed in 1987 by the present inventor and which has shown great promise embodies the RamRig™ concept. Two hydraulic piston-cylinder arrangements are used in the derrick for raising and lowering the drill string. The cylinders operate between the drill floor and a yoke which travels on guide rails in the derrick itself. The advantages of this concept are numerous. Among the most important are that is possible to place the drill floor at a higher level than the platform floor, that a derrick may be constructed having a significantly lower air resistance, and that a higher level of safety and longer lifetime are attained for the most expensive components of the derrick.

Since it is possible to position the drill floor higher than the platform floor, pipe handling is significantly simplified. There is no longer any need to arrange the pipe handling equipment at a high level in the derrick. All pipe handling equipment may be placed on the platform floor and the drill floor.

U.S. Pat. No. 4,341,373 shows a similar derrick structure, where a yoke is slidably mounted on guide rails and is raised with the aid of a plurality of piston-cylinder arrangements. A travelling block is suspended from the yoke by a plurality of wire lines. In the travelling block is mounted the top drive.

The object of the present invention is to solve an important practical problem in the realization of the RamRig™ concept. This problem consists of the need to periodically change gaskets on the piston and/or cylinder in the piston-cylinder arrangement. This is very important with respect to safety. By means of the features disclosed in the characterizing clause of the subsequent claim 1, and the method disclosed herein we have succeeded in providing a simple mounting apparatus for the cylinder which permits rapid and uncomplicated changing of the gaskets.

The invention will now be explained in greater detail with reference to the enclosed drawings, where FIG. 1 shows a RamRig™ derrick in every essential detail;

Figure 1:
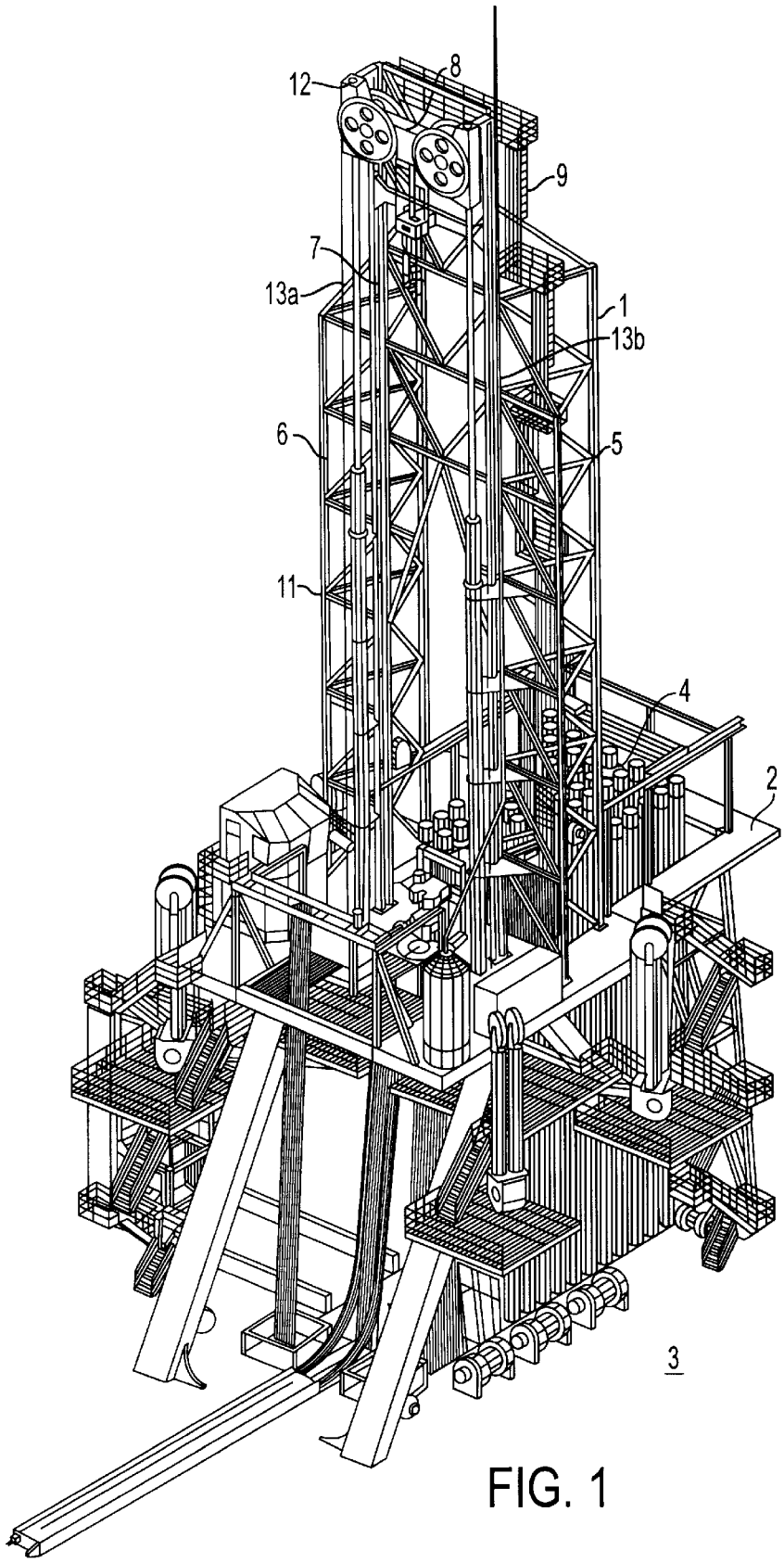

FIG. 1 shows a derrick 1 positioned on a drill floor. Drill floor 2 is arranged at a higher level than the platform floor 3, enabling the pipe handling equipment 4 to be placed mainly between the platform floor 3 and drill floor 2. Derrick 1 is generally gantry-shaped. having gantry legs 5, 6. Guide rails 7 for a yoke 8 and a top drive 9 run along each gantry leg 5, 6. Hydraulic piston-cylinder arrangements 10 and 11 are positioned so as to extend along each gantry leg 5, 6, and operate between drill dloor 2 and yoke 8, for moving yoke 8 vertically along guide rails 7.

The yoke 8 is provided with a plurality of sheaves 12, preferably four, for running the wire lines 13. Wire lines 13 extend from drill floor 2 along each gantry leg 5, 6, over sheaves 12 and down to top drive 9. By retracting and extending the piston-cylinder arrangement 10, 11, it is thereby possible to raise and lower top drive 9.

Figure 2:
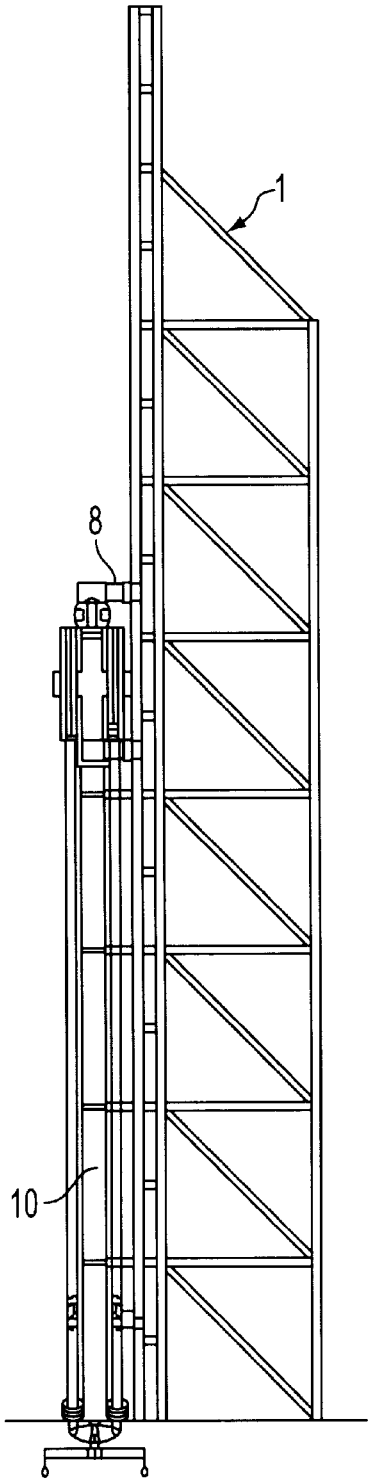
FIG. 2 shows the derrick schemaatically, viewed from the side.
Figure 3:
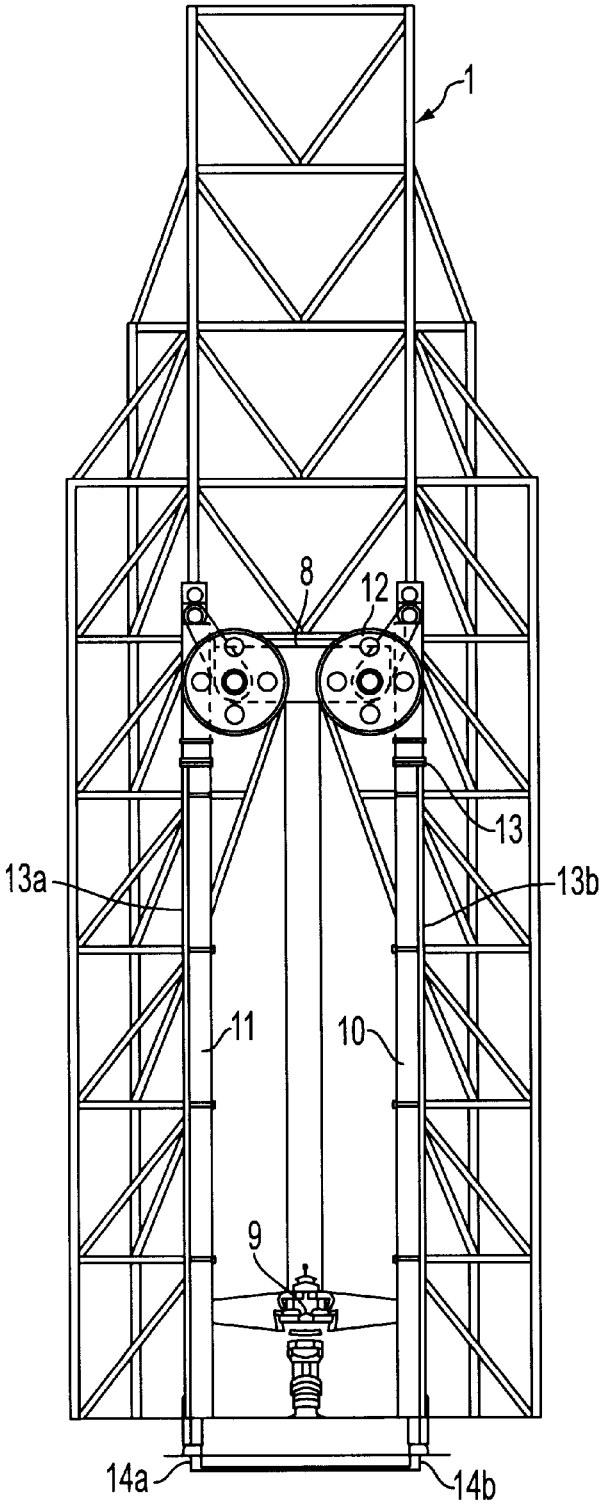
FIG. 3 shows the derrick schematically, viewed from the front, with the top drive in its lowermost position.
Figure 4:
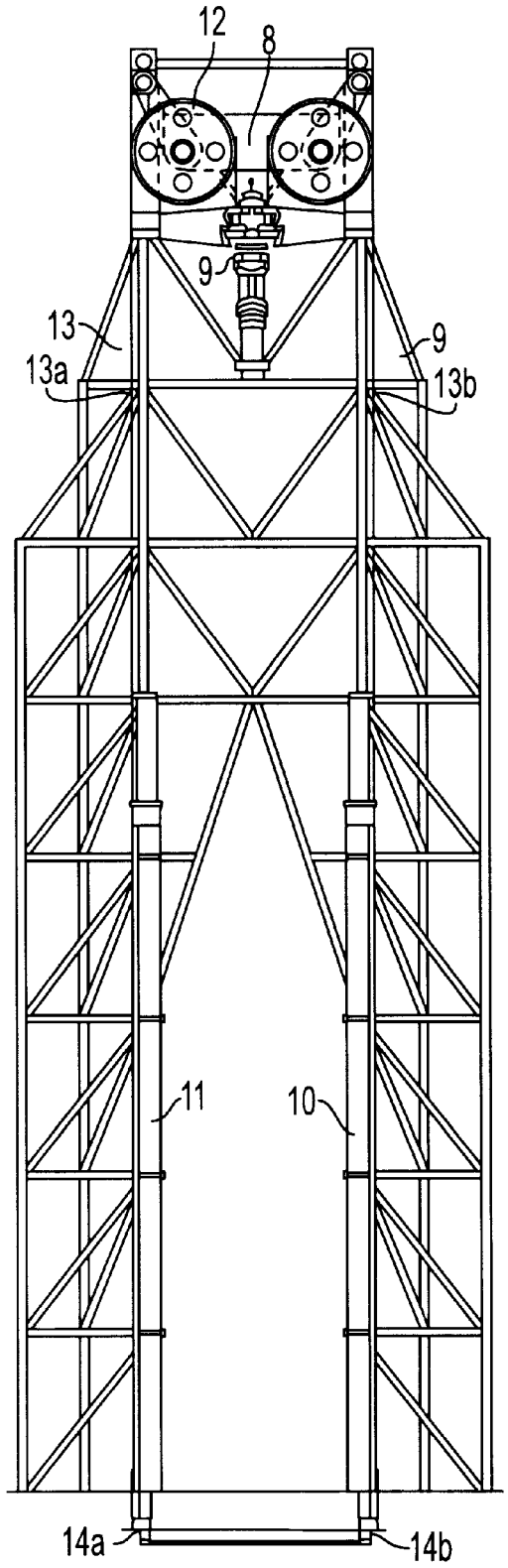
FIG. 4 shows the derrick schematically, viewed from the front, with the top drive in its uppermost position.

In FIGS. 2, 3 and 4 the function of the hoisting system is seen most clearly. In FIGS. 2 and 3 the piston-cylinder arrangement 10, 11 is shown in a completely retracted state. Top drive 9 is then at its lowermost position, quite close to the drill floor. Yoke 8 is at the upper end of the piston-cylinder arrangement.

When the pistons in the piston-cylinder arrangement are extended, yoke 8 is lifted along guide rails 7 and up to the top of derrick 1. The top drive is then lifted, as a result of the transmission generated as wire lines 13 are run over sheaves 12, from its position adjacent drill floor 2 to a position directly below yoke 8. The height to which top drive 9 is lifted is thus the double of that to which yoke 8 is lifted.

There may, for example, be as many as eight wire lines 13 arranged in the hoisting apparatus described above, with the wire lines being strung two by two in their respective tracks over the same sheave 12. On yoke 8 four sheaves are arranged in pairs at each end of yoke 8. Wire lines 13 are thus arranged in two sets 13*a* and 13*b*, extending from attachment points 14*a* and 14*b* at drill floor 2, over sheaves 12 and down to top drive 9. Attachment points 14*a* and 14*b* are spaced apart horizontally by a distance corresponding approximately to the length of yoke 8.

Figure 7:
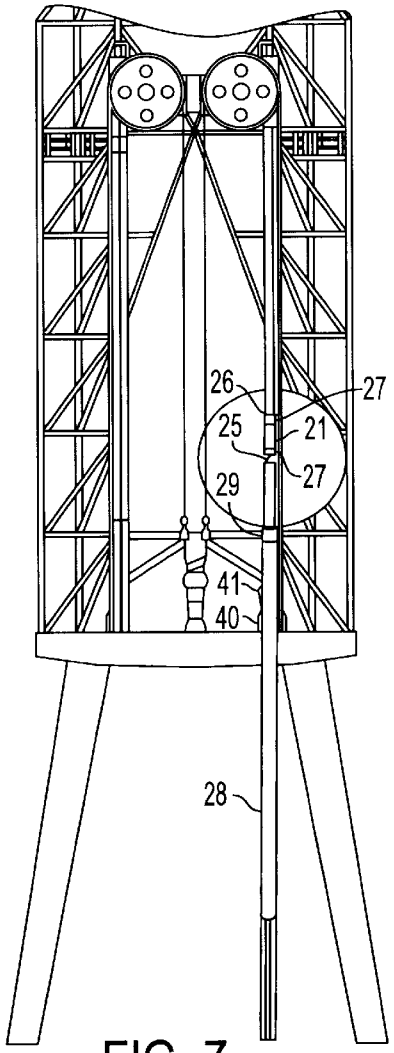
FIGS. 5–7 show a section of the derrick and the drill floor and illustrate the lowering of one of the cylinders in sequence.
Figure 6:
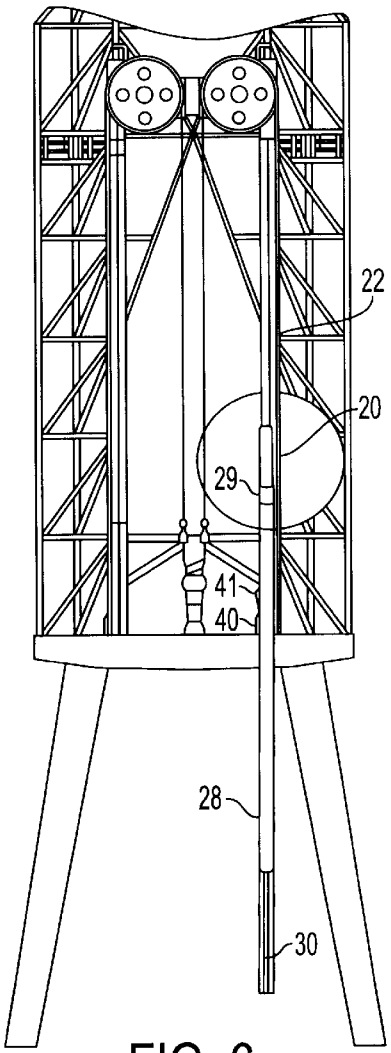
Figure 5:
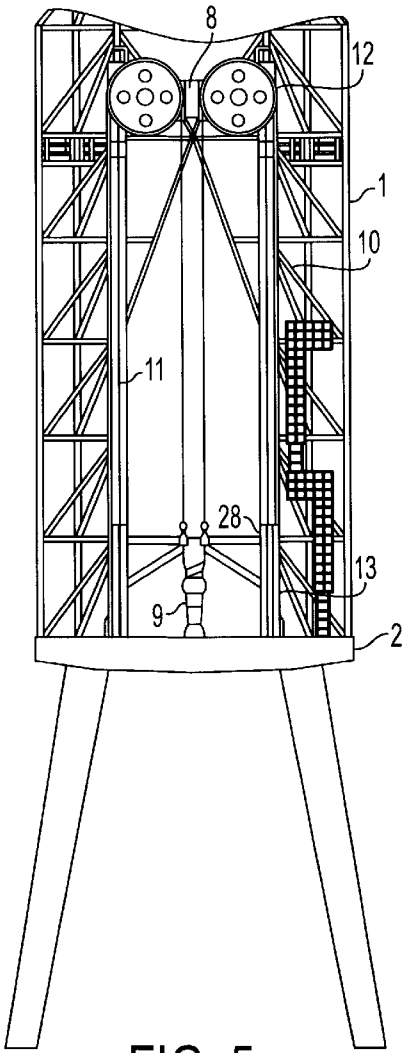

FIGS. 5–7 provide a schematic illustration of the lower portion of derrick 1 and drill floor 2. Here are also shown the piston-cylinder arrangements 10, 11, yoke 8 with sheaves 12 and top drive 9. Wire lines 13 run from drill floor 2 over their respective sheaves 12 and down to top drive 9.

Each piston-cylinder arrangement 10, 11 consists of a cylinder 20 and a piston 21 having piston rod 22. Cylinder 20 is secured at one end thereof to drill floor 2, while piston rod 22 is attached to yoke 8. Piston 21 divides the cylinder into two chambers, a lower chamber and an upper chamber. The lower chamber is circular-cylindrical and delimited only by the walls of cylinder 20 and the lower end surface 25 of the piston. The upper chamber is also delimited by the walls of cylinder 20, but in addition is bounded by piston rod 22 and the upper annular surface 26 of piston 21. the piston is further provided with one or more gaskets 27, and the cylinder comprises an end cover (not shown) with a gasket (not shown) for sealing off cylinder 20.

Cylinder 20 is suspended in a support column 28 in a suspension device 29 at the upper end of support column 28. Feed lines 30 for supplying hydraulic fluid to cylinder 20 are inserted through an opening in the lower end of the support column. Support column 28 is, on its part, fixed in place with the aid of a mounting apparatus 31 (not shown in FIGS. 5–7) at drill floor 2. This mounting apparatus 31 is illustrated in detail in FIGS. 8–13, which figures show a detailed section at drill floor 2.

Figure 8A:
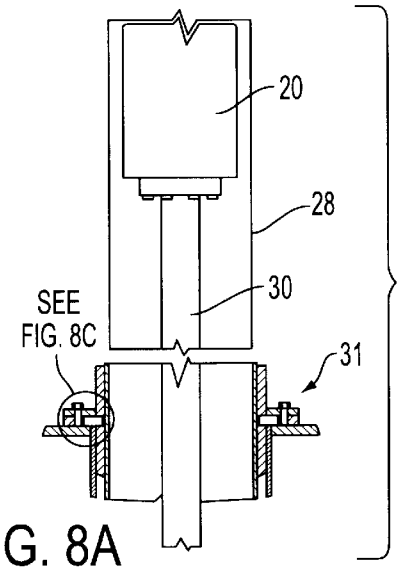
Figure 8B:
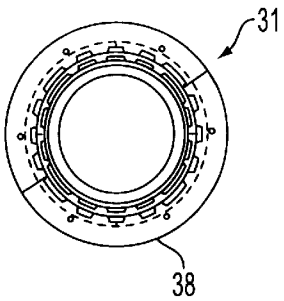
Figure 8C:
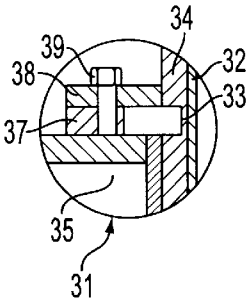
Figure 13:
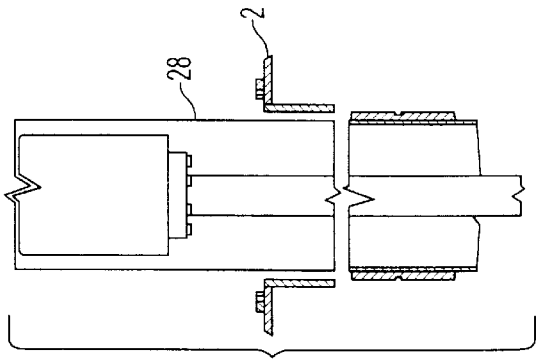
Figure 12A:
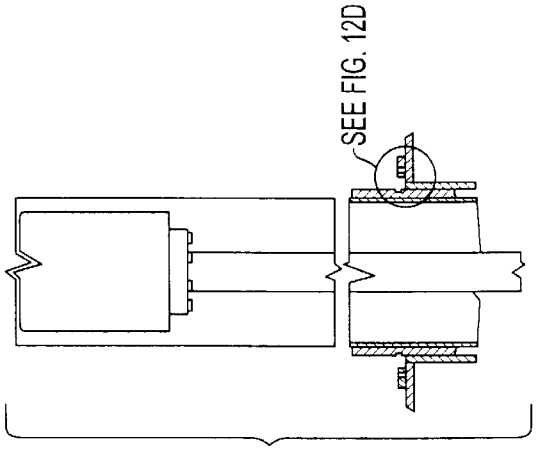
Figure 12B:
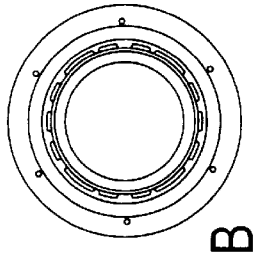
Figure 12C:
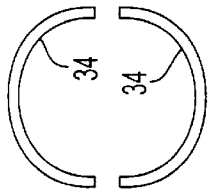
Figure 12D:
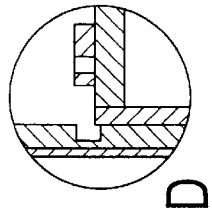
Figure 11A:
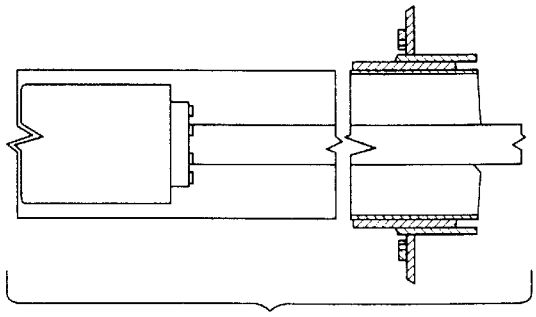
Figure 11B:
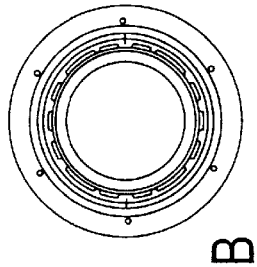

FIGS. 8(*a*)–8(*c*) shows cylinder 20 with support column 28 mounted in drill floor 2. FIGS. 8(*a*), 8(*c*), 9(*a*) and 10(*a*) show a side elevation of the mounting apparatus. FIGS. 8(*b*), 9(*b*), 9(*c*), 10(*b*) and 10(*c*) illustrate top view of the fixing devic 37 and locking means 38. Mounting apparatus 31 is also shown in an enlarged section in FIG. 8(*c*), and consists of a flange 32 fixedly joined to support column 28, in which flange 32 is formed a groove 33 which extends around the periphery of support column 28. When the mounting apparatus 31 is in assembled state, a locking ring 34 is engaged with groove 33. Locking ring 34 also rests against drill floor 2, either directly or via a structure firmly connected with drill floor 2. To permit the attachment and removal of locking ring 34, the ring 34 is separated into two or more segments.

Radially exterior to locking ring 34 is provided a safety ring 35 which is also separated into two or more segments. Safety ring 35 is adapted to hold locking ring 34 in engagement with groove 33 in flange 32, and thus fills out a gap 36 between locking ring 34 and a fixing device 37, which is firmly connected with drill floor 2. To prevent safety ring 35 from moving upwards and thus out of gap 36, a locking means 38, also divided into two or more sections, is arranged over said ring.

Locking means 38 may be secured to fixing device 37 with the aid of, for example, a plurality of bolts 39.

Figure 9A:
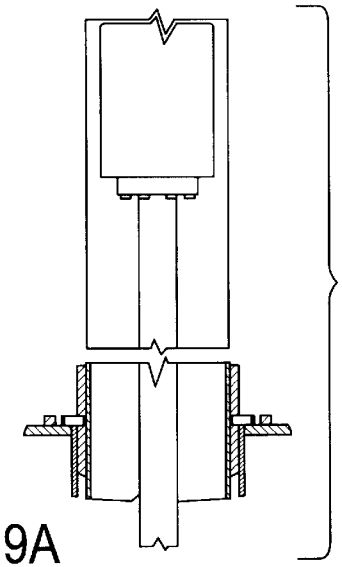
Figure 9B:
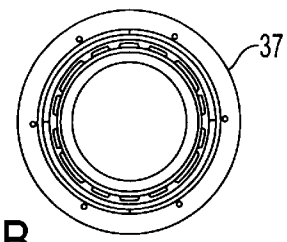
Figure 9C:
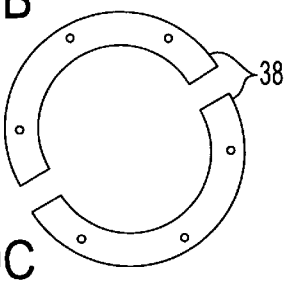

With the aid of FIGS. 5–13, the method of changing piston gaskets 27 and the gasket for cylinder 20 at the upper end thereof will now be explained. First, yoke 8 is locked securely to its guide rails 7 in derrick 1 so as to relieve the downward-directed force of the piston-cylinder arrangement 10, 11. Then the mounting apparatus 31 is loosened, first by unscrewing bolts 39 to enable the removal of locking means 38. This results in the situation depicted in FIGS. 9(*a*)–9(*c*). FIG. 9(*c*) illustrates the removed locking means 38. FIGS. 9(*a*) and 9(*b*) show a side elevation and top view of the mounting apparatus having the locking means removed. The fixing device 37 is visible.

Figure 10A:
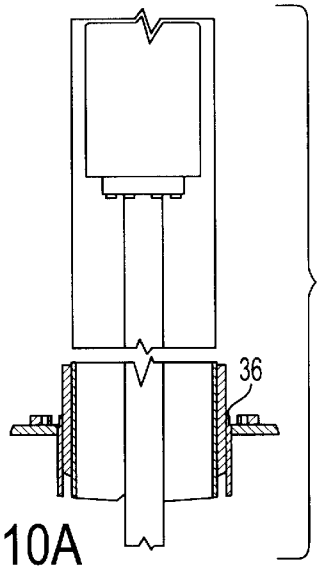
FIGS. 8–13 show in detail the apparatus for mounting the cylinder and illustrate in detail the solution for this mounting process.
Figure 10B:
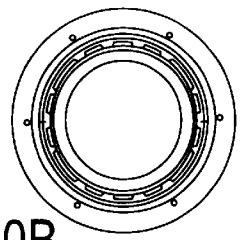
Figure 10C:
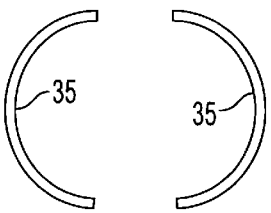

Now it is possible to lift safety ring 35 out of gap 36 as shown in FIGS. 10(*a*)–10(*c*). The safety ring 35 is illustrated in FIG. 10(*c*) and the remainder of the mounting apparatus is illustrated in FIGS. 10(*a*) and 10(*b*).

Now the locking ring 34 is exposed. However, it is now clamped between the upper wall of groove 33 and drill floor 2. Cylinder 20 and support column 28 must thus be raised slightly in order to nullify this clamping effect. This may be done in a variety of ways. For example, one may apply a pressure in cylinder 20 on the rod side 26 of piston 21 and, with the aid thereof, raise cylinder 20 and support column 28. Another way to do this is to position a jack 40 (see FIG. 6 and FIG. 7), or the like, between drill floor 2 and a projection 41 on support column 28, or between platform floor 3 and support column 28. If desired, another type of lifting device may be used.

FIGS. 12(*a*), 12(*b*) and 12(*d*) illustrate the situation after locking ring 34 has been removed from the mounting apparatus, where locking ring 34 is shown in FIG. 12(*c*). An enlarged section of the remaining part of mounting apparatus 31 is also shown in FIG. 12(*d*).

When the mounting apparatus for support column 28 has now been loosened, the support column 28 with cylinder 20 may be lowered downward in relation to drill floor 2. This lowering may be done, for example, by controlled release of the pressure on the top side 26 of piston 21. Said lowering may be carried out until piston 21 rests against the end cover of cylinder 20. Now the end cover must be removed in order for cylinder 20 to be drawn off piston 21. To hold cylinder 20 during the removal of the end cover, some form of hoisting or lifting apparatus, for example, a jack 40, must be provided.

After cylinder 20 has been drawn completely off piston 21, the gaskets 27 on piston 21 may be changed in a conventional manner. Gaskets in the end cover of cylinder 20 and any gaskets at the upper end of the cylinder may also be changed in a conventional manner.

In remounting of cylinder 20, it is lifted up and drawn down over piston 21 with the aid, for example, of jacks 40. Then the end cover may be mounted and pressure may again be applied in cylinder 20 on the upper side 26 of piston 21, whereby with the aid of this hydraulic pressure the cylinder may be raised upward in relation to drill floor 2 until groove 33 in flange 32 aligns with fixing device 37. Locking ring 34 is then put into place, cylinder 20 with support column 28 is lowered downward until locking ring 34 rests on drill floor 2, and safety ring 35 is positioned in gap 36, thereafter to be securely locked with the aid of locking means 38 and bolts 39. The changing of the gaskets is now completed, and the only task remaining is to release the yoke 8 from its locked position on the guide rails.

Although a specific embodiment of the mounting apparatus is described in the above, the present invention is not restricted to the use of this specific embodiment. Locking ring 34 may also be held in engagement with groove 34 in other ways and with the aid of devices other than those shown and described herein. During the process, certain steps in the method may be carried out in a different sequence; for example, one may remove the cylinder's end cover before commencing the lowering of the cylinder in relation to the drill floor, but then it will not be possible to utilize hydraulic pressure on the rod side of the piston to execute a controlled lowering, and one would thus have to use other types of hoisting or lifting devices in order to accomplish this.

What is claimed is:

1. An apparatus for mounting a piston-cylinder arrangement in a derrick (1) placed on a drill floor (2), wherein said piston-cylinder arrangement (10, 11) is adapted to raise and lower a yoke (8) which travels on guide rails (7) in the derrick (1), and comprises a cylinder (20), a piston (21), and a piston rod (22), wherein said piston rod (22) is joined at one end thereof to the piston (21), wherein said piston (21) is adapted to be inserted into the cylinder (20), wherein an end of said piston rod (22) opposite the piston (21) being connected to the yoke (8), and the cylinder (20) being held securely with the aid of a mounting apparatus (31) in relation to the drill floor (2), characterized in that the cylinder (20), for the changing of gaskets (27) on the piston (21) and the cylinder (20), is arranged so as to be lowerable in relation to the mounting apparatus (31) thereof, and that the mounting apparatus (31) therefor is designed to be releasable and comprises a flange (32) permanently mounted on the cylinder (20), a fixing device (37) in fixed position in relation to the drill floor (2), a dividable locking ring (34), and a locking means (38), said locking ring (34) being adapted for engagement between the flange (32) and the fixing device (37) and being firmly held in engagement with the aid of the locking means (38).

2. An apparatus in accordance with claim 1, characterized in that the locking ring (34) is adapted for placement in engagement with a groove (33) in the flange (32), which groove (33) extends continuously or with interruption around a substantial portion of the periphery of the cylinder (20), and that the locking ring (34) is maintained in said engagement with the aid of a dividable safety ring (35) which is placed between the locking ring (34) and the fixing device (37).

3. An apparatus in accordance with claim 2, characterized in that the locking means (38) constitutes a dividable flange which in mounted state is secured to the fixing device (37) and bears against the safety ring (35) and optionally also the locking ring (34).

4. An apparatus in accordance with claim 1, 2 or 3, characterized in that the cylinder (20) is suspended in a support column (28) which encloses the cylinder (20) and that the flange (32) is attached to this support column (28).

5. A method of changing gaskets in at least one piston-cylinder arrangement (10,11) in a derrick (1) located on a drill floor (2), said at least one piston-cylinder arrangement (10,11) being adapted to raise and lower a yoke (8), which travels on guide rails (7) on the derrick (1), each of said at least one piston-cylinder arrangement (10, 11) comprising a cylinder (20), a piston (21) and a piston rod (22), wherein said piston rod (22) is joined at one end thereof to said piston (21), wherein said piston (21) is adapted to be inserted into said cylinder (20), an end of said piston rod (22) opposite said piston (21) being connected to the yoke (8), and said cylinder (20) being held securely with the aid of mounting apparatus (31) in relation to the drill floor (2), said method comprising the steps of:

locking the yoke (8) to the derrick;

relieving hydraulic pressure within said cylinder (20);

exposing a locking device (38);

removing a locking ring (34) from engagement with a flange (32) mounted on said cylinder (20);

removing an end cover from said cylinder (20);

lowering said cylinder (20) in relation to the drill floor (2) and said piston rod (22) such that said piston rod (22) is completely drawn out of said piston (21);

removing at least one gasket (27) on said piston;

replacing said at least one gasket (27) on said piston;

raising said cylinder (20) such that said cylinder (20) is slid back onto piston (21) whereby said flange (32) is aligned with a fixing device (37);

mounting the end cover on said cylinder (20);

engaging the locking ring (34) between the flange (32) and the fixing device (37);

securing the locking device (38) in place;

restoring hydraulic pressure within said cylinder (20); and releasing the yoke (8) from the locked position on the derrick (2).

6. The method of changing gaskets according to claim 5, further comprising the steps of:

removing at least one gasket from at least one of an upper end and the end cover of said cylinder (20); and replacing said at least one gasket from at least one of the upper end and the end cover of said cylinder (20).

7. A method in accordance with claim 5, characterized in that, prior to removal of the end cover for the cylinder (20), pressure is applied in a chamber of the cylinder (20), on the piston rod side (26) of the piston (21), to effect controlled lowering of the cylinder (20) in relation to the drill floor (2), that the end cover is then removed, and that the further lowering and withdrawal of the cylinder (20) from the piston (21) is carried out with the aid of a separate hoisting/lifting apparatus.

8. A method in accordance with claim 5 or 6, characterized in that the cylinder (20) is raised slightly after the locking device (38) is released to nullify any possible clamping effect between the locking ring (34), a groove (33) in the flange (32) and the drill floor (2).

* * * * *